US010017989B1

(12) United States Patent
Kellogg

(10) Patent No.: US 10,017,989 B1
(45) Date of Patent: Jul. 10, 2018

(54) ANTI-SLIP LADDER SHOE ADAPTER

(71) Applicant: Shea Kellogg, Pouce Coupe (CA)

(72) Inventor: Shea Kellogg, Pouce Coupe (CA)

( * ) Notice: Subject to any disclaimer, the term of this patent is extended or adjusted under 35 U.S.C. 154(b) by 0 days.

(21) Appl. No.: 15/145,867

(22) Filed: May 4, 2016

Related U.S. Application Data

(60) Provisional application No. 62/158,639, filed on May 8, 2015.

(51) Int. Cl.
*E06C 7/46* (2006.01)
*E06C 1/04* (2006.01)
*E06C 1/12* (2006.01)

(52) U.S. Cl.
CPC ..... *E06C 7/46* (2013.01); *E06C 1/04* (2013.01); *E06C 1/12* (2013.01)

(58) Field of Classification Search
CPC ..... E06C 7/42; E06C 7/46
USPC ..... 182/108, 109
See application file for complete search history.

(56) References Cited

U.S. PATENT DOCUMENTS 412,199 A 10/1889 McIlhenny
625,066 A * 5/1899 Seagrave ..... E06C 7/46 182/111
776,446 A * 11/1904 Williamson ..... E06C 7/46 182/107
1,193,043 A * 8/1916 Merrin ..... E06C 7/46 182/111
1,379,808 A * 5/1921 Fies ..... E06C 7/46 182/111
1,431,068 A * 10/1922 Waney ..... E06C 7/44 182/109
1,450,694 A * 4/1923 Mahoney ..... E06C 7/42 182/107
1,536,434 A * 5/1925 Hearn ..... E06C 7/46 182/111
1,570,576 A 1/1926 Rivitz
1,897,840 A * 2/1933 Greene ..... E06C 7/46 182/111
1,973,226 A * 9/1934 Rose ..... E06C 7/46 182/109
2,145,619 A 1/1939 Brown
2,318,017 A * 5/1943 Schmidt ..... E06C 7/44 182/109
2,574,286 A * 11/1951 Rein ..... E06C 7/42 182/111
2,691,479 A 10/1954 Sharp
2,767,898 A 10/1956 Cramer
2,992,696 A * 7/1961 Jedinak ..... E06C 1/10 182/108
3,012,628 A * 12/1961 Zumbaum ..... E06C 7/42 182/111

(Continued)

FOREIGN PATENT DOCUMENTS

CA 2234303 A1 10/1999
CA 2653138 A1 8/2010
GB 2057040 A * 3/1981 ..... E06C 7/46

*Primary Examiner* — Daniel P Cahn
(74) *Attorney, Agent, or Firm* — Aaron R. Cramer; Cramer Patent & Design, PLLC.

(57) ABSTRACT

An adapter configured to removably affix to an existing shoe of a ladder provides traction on icy and other surfaces exhibiting similar friction coefficients. Each adapter is provided with a serrated bottom surface in a first embodiment or a spiked bottom surface in a second embodiment to provide superior traction.

2 Claims, 4 Drawing Sheets

(56) References Cited

U.S. PATENT DOCUMENTS 3,456,757 A * 7/1969 Sain ..... E06C 7/46 182/111
3,858,684 A * 1/1975 Goings ..... E06C 7/46 182/111
4,415,062 A 11/1983 Shaw
4,450,850 A * 5/1984 McKenna ..... A61H 3/0288 135/78
4,576,250 A * 3/1986 Marish ..... E06C 7/46 182/108
4,669,576 A * 6/1987 Jones ..... E06C 7/46 182/108
4,683,980 A * 8/1987 Vayko ..... E06C 7/44 182/108
4,836,331 A 6/1989 Foradori
5,054,579 A 10/1991 Moson
5,337,856 A 8/1994 Fillers
5,954,075 A * 9/1999 Gilmour ..... A61F 5/0127 135/65
6,012,546 A * 1/2000 Bee ..... E06C 7/44 182/106
6,053,284 A * 4/2000 Fountain ..... E06C 7/423 182/180.2
6,145,618 A * 11/2000 Verenski ..... E06C 7/46 182/109
6,805,221 B1 * 10/2004 Lee ..... E06C 1/34 182/107
7,073,821 B2 * 7/2006 Lagsdin ..... B60S 9/02 248/633
7,172,216 B1 * 2/2007 Lagsdin ..... B60S 9/02 280/763.1
7,802,814 B2 * 9/2010 Lagsdin ..... B60S 9/02 280/763.1
7,900,962 B2 * 3/2011 Lagsdin ..... E02F 9/085 280/763.1
8,807,277 B1 * 8/2014 Reyna Lerma ..... E06C 7/42 182/108
9,133,594 B2 * 9/2015 Hurley ..... E02D 5/80
2002/0036403 A1 * 3/2002 Lagsdin ..... B60S 9/02 280/763.1
2005/0011702 A1 * 1/2005 Zeaman ..... E06C 7/42 182/108
2006/0124393 A1 * 6/2006 Robinson ..... E06C 7/46 182/107
2007/0193827 A1 * 8/2007 Lambert ..... E06C 7/46 182/108
2008/0223657 A1 * 9/2008 Keefe ..... E06C 7/46 182/108
2011/0017549 A1 * 1/2011 Lietz ..... E06C 1/06 182/172
2011/0100752 A1 * 5/2011 Donlon ..... E06C 7/42 182/107
2011/0132684 A1 * 6/2011 Wilkins ..... E06C 7/46 182/107
2012/0175189 A1 * 7/2012 Stewart ..... E06C 7/46 182/111
2012/0199416 A1 * 8/2012 Hopkins ..... E06C 7/46 182/111
2013/0048427 A1 * 2/2013 Sordo ..... E06C 7/46 182/110
2014/0138184 A1 * 5/2014 Hernandez ..... E06C 7/46 182/109
2015/0159435 A1 * 6/2015 Vela ..... E06C 7/46 182/129

* cited by examiner

ANTI-SLIP LADDER SHOE ADAPTER

RELATED APPLICATIONS

The present invention was first described in and claims the benefit of U.S. Provisional Application No. 62/158,639, filed May 8, 2015, the entire disclosures of which are incorporated herein by reference.

FIELD OF THE INVENTION

The present invention relates to a traction implement adapted to be used with a ladder and provide added traction on hard and icy surfaces.

BACKGROUND OF THE INVENTION

There is a seemingly endless list of activities performed at home, work, and countless other settings that require the use of an extension ladder in order to allow its user to gain access to areas that otherwise would be inaccessible. As ladder use is oftentimes a year-round necessity, many times such ladders are used in hazardous wintertime conditions where snow, ice, and otherwise slippery and unstable ground conditions exist.

In fact, such hazardous ladder use is frequently necessitated in winter climates when a user is putting up and taking down outdoor decorations, clearing ice dams from gutters and in some areas of the world, removing dangerously heavy snow accumulations from a rooftop. Should the base of the ladder slip on icy ground or unsure ground when the ladder is in use, serious injury or even death may result.

Many extension ladders are often provided with pivotally-attached shoes with rubber feet to increase traction. However, these rubberized feet may become brittle in frigid environments thereby having the negative effect of decreasing surface friction when most needed. Accordingly, there is a need for a means by which the use of extension ladders can be made safer in any environmental condition but especially so in hazardous winter conditions. The development of the present invention fulfills this need.

SUMMARY OF THE INVENTION

The present invention advantageously fills the aforementioned deficiencies by providing a traction adapter, comprising a front side opening, a rear side opening, a bottom side, a top side opposite the bottom side, a first side, and a second side opposite the first side. The adapter also comprises a plurality of teeth which project away from the front side portion of each of the first and second sides of the adapter and are simultaneously arrayed from the bottom side portion of the adapter to the top side portion of the same. There is at least one (1) aperture, which may or may not be threaded, which is disposed on at least one (1) of the first and second sides.

The adapter also comprises a first retention plate which is disposed on and is adjacent to the front side opening of its top side while also being subjacent to the same, a second retention plate which is disposed on and is adjacent to the front side opening of its bottom side while also being superjacent to the bottom side of the same and at least one (1) attachment mechanism each of which may be configured to removably secure the adapter to the ancillary object through an individual aperture. The ancillary object may be a ladder.

The bottom side, the top side, the first side, and the second side form an inner cavity which is configured to receive an ancillary object. The first and second retention plates are configured to obstruct motion of the ancillary object when it is inserted into the cavity through the back side opening. The first and second retention plates are configured to likewise support the ancillary object in an upright position by providing a buttress for each end of the ancillary object. And the plurality of teeth is configured to make contact with a surface when the adapter is secured to the ancillary object in an upright position. The plurality of teeth may comprise triangular shapes.

Each attachment mechanism may also comprise a bolt having a first and second end. The bolt may also comprise a first fixed nut which is disposed on the first end. The first fixed nut may comprise a wing nut. The bolt may also have a second fixed nut which is disposed on the second end. The adapter may comprise a heavy gauge metal or a corrosion resistant material. The adapter may also comprise a coating which has a glass transition temperature and modulus of elasticity which is suitable for temperature ranges from negative forty degrees Fahrenheit to one hundred twenty degrees Fahrenheit (−40°-120° F.).

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
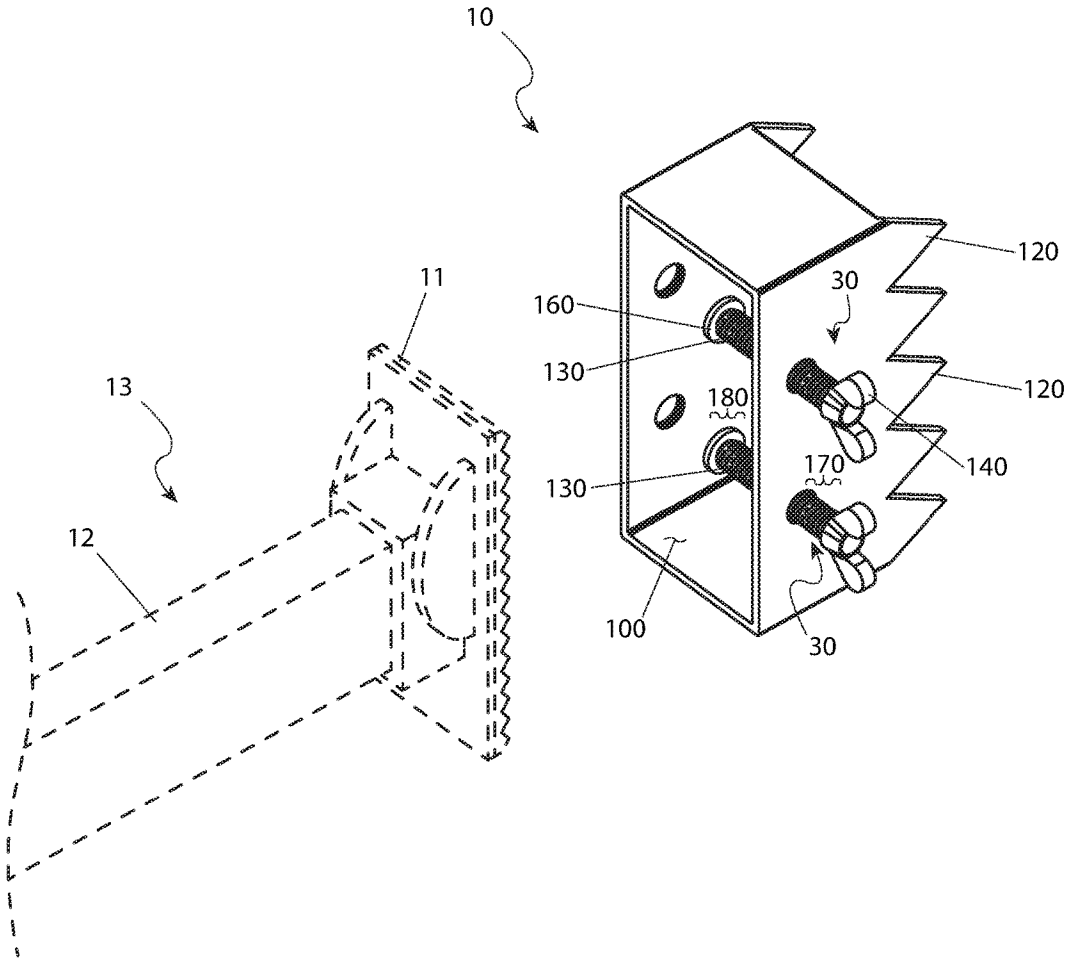
FIG. 1 is an environmental top side 70 second side 90 view of the anti-slip ladder shoe adapter 10, in accordance with the preferred embodiment of the present invention having an alternate embodiment of an attachment mechanism 30.
Figure 3:
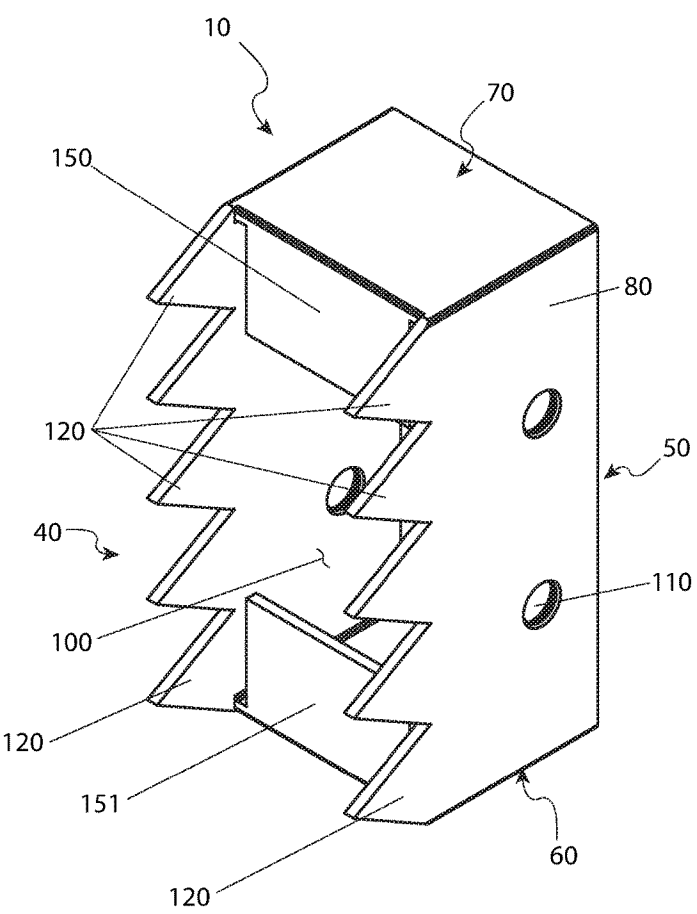
FIG. 3 is a perspective top side 70 first side 80 view of the adapter 10, without attachment mechanism 30, in accordance with the preferred embodiment of the present invention.
Figure 2:
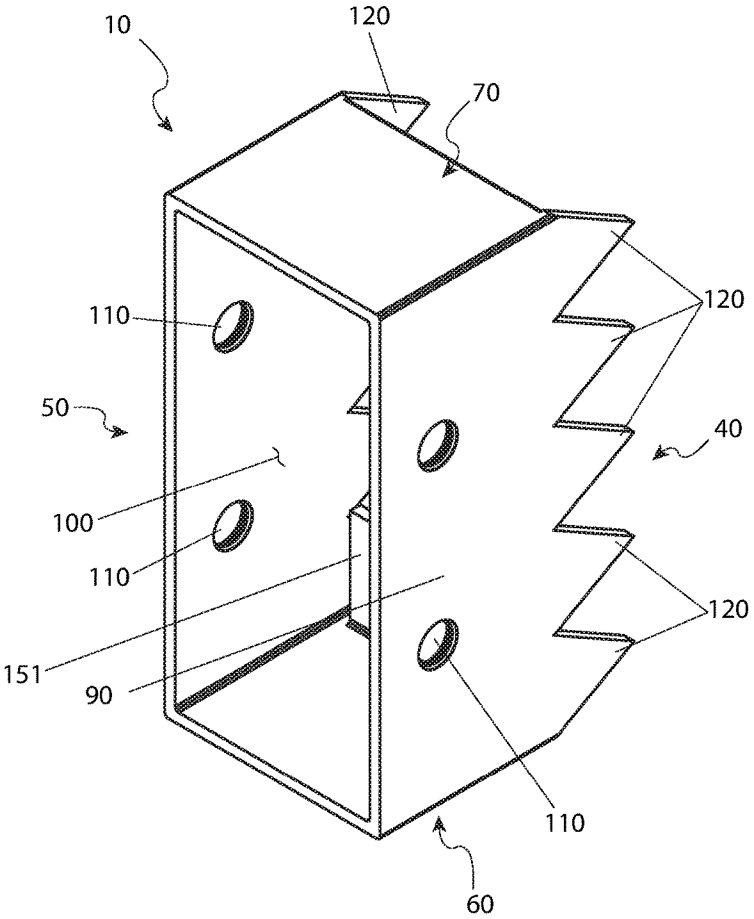
FIG. 2 is a perspective top side 70 second side 90 view of the adapter 10, without attachment mechanism 30, in accordance with the preferred embodiment of the present invention.
Figure 5:
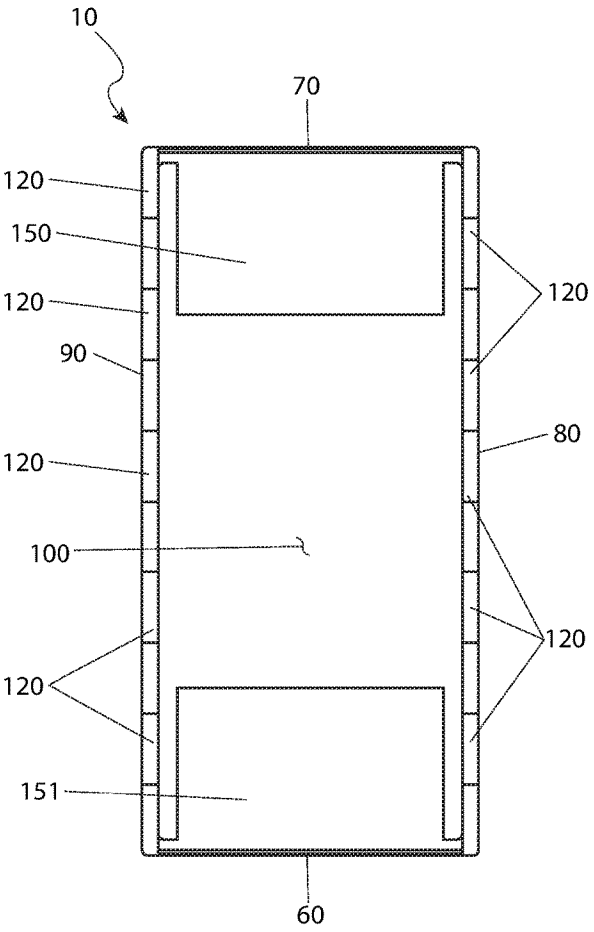
FIG. 5 is a front side 40 view of the adapter 10, without attachment mechanism 30, in accordance with the preferred embodiment of the present invention.
Figure 4:
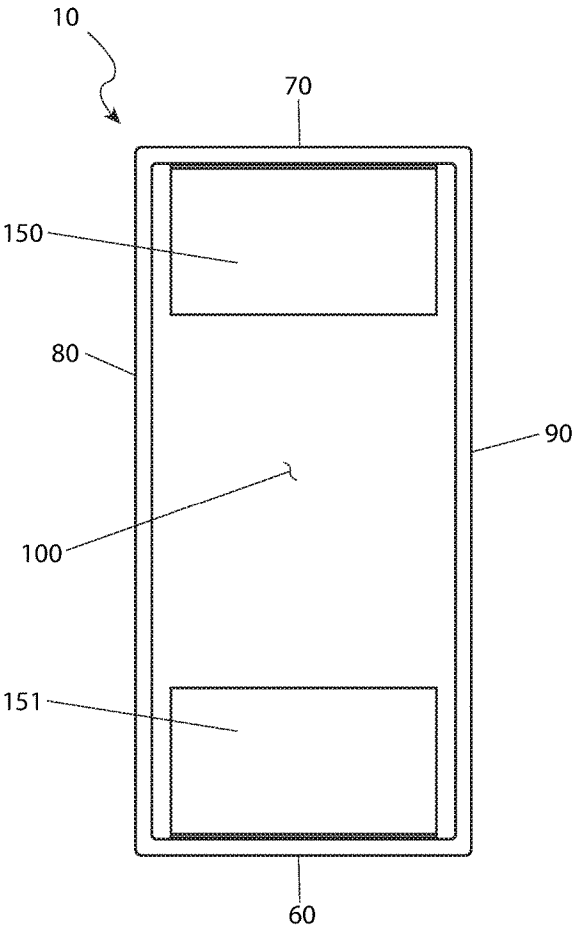
FIG. 4 is a rear side 50 view of the adapter 10, without attachment mechanism 30, in accordance with the preferred embodiment of the present invention.
Figure 6:
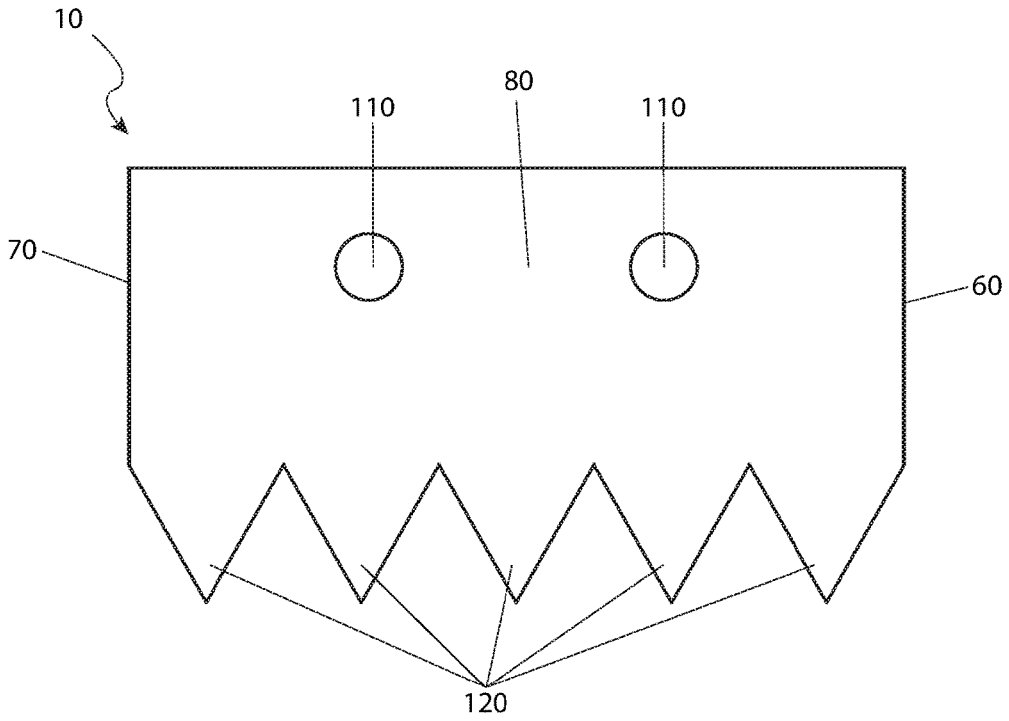
FIG. 6 is a first side view 80 of the adapter 10 with the second side view 90 of the adapter 10 being a mirror image thereof, without attachment mechanism 30, in accordance with the preferred embodiment of the present invention; and, FIG. 7 is a top side 70 view of the adapter 10 with the bottom side 60 view of the adapter 10 being a mirror image thereof, without attachment mechanism 30, in accordance with the preferred embodiment of the present invention.
Figure 7:
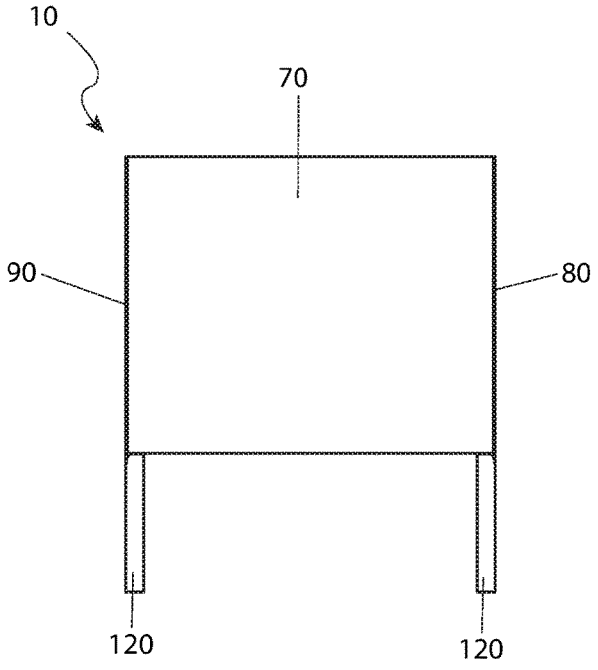

10 anti-slip ladder shoe adapter
11 ladder shoe
12 ladder rail
13 ladder
30 attachment mechanism
40 front side

50 rear side
60 bottom side
70 top side
80 first side
90 second side
100 inner cavity
110 threaded aperture
120 tooth
130 threaded bolt
140 first fixed nut
150 first retention plate
151 second retention plate
160 second fixed nut
170 first end
180 second end

DETAILED DESCRIPTION OF THE PREFERRED EMBODIMENT

The best mode for carrying out the invention is presented in terms of its preferred embodiment 10, with alternate attachment mechanism 30, herein depicted with FIG. 1, and the preferred embodiment, without an attachment mechanism 30, of any configuration, herein depicted within FIGS. 2 through 7. However, the invention is not limited to the described embodiment, and a person skilled in the art will appreciate that many other embodiments of the invention are possible without deviating from the basic concept of the invention and that any such work around will also fall under the scope of this invention. It is envisioned that other styles and configurations of the present invention can be easily incorporated into the teachings of the present invention, and only one (1) particular configuration shall be shown and described for purposes of clarity and disclosure and not by way of limitation of scope.

The terms "a" and "an" herein do not denote a limitation of quantity, but rather denote the presence of at least one (1) of the referenced items.

The present invention describes an anti-slip ladder shoe adapter 10 with an attachment mechanism 30 (herein referred to as the "adapter"), which provides added traction and support for a user when employing a ladder 13 on hard and/or icy ground surfaces.

Referring now to FIG. 1, an environmental view of the anti-slip ladder shoe adapter 10, in accordance with the preferred embodiment of the present invention, is disclosed. The adapter 10 in FIG. 1 further comprises at least one (1) alternate attachment mechanism 30 that are used to fit over existing ladder shoes 11 of a ladder 13 to help prevent slipping when the ladder 13 is used on hard and/or icy terrain. It is envisioned for the adapter 10 to be used in pair so that an adapter 10 is employed for each ladder shoe 11; however, for simplicity and ease of illustration, only one (1) adapter 10 and one (1) attachment mechanism 30 will be described and illustrated. It is understood that each adapter 10 and attachment mechanism 30 are identical. In a preferred use, an adapter 10 is attached to each ladder shoe 11. The ladder 13 is then set up in the normal manner so that each adapter 10 provide added traction and support when the ladder is employed on hard and/or icy surfaces, particularly when used as pairs of adapters 10.

Referring now to FIGS. 2 through 7, perspective and rear, front, first side, second side, top and bottom views of the adapter 10, in accordance with the preferred embodiment of the present invention, are disclosed. Each adapter 10 preferably comprises a heavy gauge metal product, and is approximately five inches (5 in.) wide, two inches (2 in.) high, and one and one-fourth inches (1¼ in.) in depth; however, other materials and dimensions may be utilized without deviating from the teachings of the adapter 10. Each adapter 10 is further envisioned to comprise a corrosion resistant material or have a corrosion resistant coating. Any materials used for the adapter 10 or coating will have a glass transition temperature and modulus of elasticity suitable for temperature ranges from negative forty degrees Fahrenheit to one-hundred twenty degrees Fahrenheit (−40° F. to 120° F.). Each adapter 10 is provided with a substantially rectangular hollow construction, and has a front 40, a rear 50, a bottom 60, a top 70, a first side 80, and a second side 90. This construction forms an inner cavity 100 through which a ladder shoe 11 is inserted during operation of the adapter 10.

Each adapter 10 is provided with at least one (1) threaded aperture 110 disposed along at least one (1) of the first or second sides 80, 90. Each side 80, 90 is provided with a plurality of teeth 120 disposed at a front 40 thereupon. The teeth 120 configuration is preferable a plurality of triangular protrusions; however, other undulated and serrated protrusions may be utilized. Whichever undulated protrusion is used, the configuration of such must be that the protrusions dig into the ice or create a high friction contact with a hard surface. The front side end 40 of the bottom 60 and top 70 are provided with a first retention plate 150 subjacent to top 70 and a second retention plate 151 respectively that protrude perpendicularly toward the inner cavity 100 and are configured to prevent a ladder shoe 11 from traveling through the rear 50 of the adapter 10, thereby securing the ladder shoe 11 within the inner cavity 100. Each retention plate 150, 151 is situated to be in an elevated position relative to the plurality of teeth 120 so that only the plurality of teeth 120 make contact with the ground when the adapter 10 is rested on its rear 50, thus the retention plates 150, 151 are configured to support the weight of the ladder 13 and a user climbing the ladder 13 while in use.

Referring back to FIG. 1 in part, the attachment mechanism 30 comprises a threaded bolt 130 with a first fixed nut 140 disposed on a first end 170 of the threaded bolt 130 for each threaded aperture 110. Each threaded bolt 130 is configured to threadingly engage an individual threaded aperture 110. As a ladder shoe 11 is received by the inner cavity 100, each threaded bolt 130 is advanced towards the inner cavity 100 by rotating the first fixed nut 140 until the second end 180 engages with the ladder shoe 11 or the opposing side 80, 90 of the adapter 10. This engagement secures the adapter 10 around the ladder shoe 11 by prohibiting the ladder shoe 11 from exiting the front 40, and the retention plates 150, 151 arrest motion of the ladder shoe 11 towards the rear 50, thereby securing the adapter 10 to the ladder 13.

Although it has been described for the attachment mechanism 30 to enable securement to a ladder shoe 11 without altering the ladder 11, it is envisioned for the threaded bolts 130 to be inserted through apertures made in the ladder rails 12, thereby securing the adapter 10 to the ladder 13 in a more physically altering manner, if it is desired to do so.

An alternate embodiment as fully disclosed in FIG. 1, provides for a second fixed nut 160 disposed at a second end 180 of the threaded bolt 130. The purpose of the second fixed nut 160 is to prevent the threaded bolt 130 from being completely removed from the threaded aperture 110 with which it is engaged. In this embodiment, each threaded bolt 130 is already threadingly engaged with a threaded aperture 110 before the first and second fixed nuts 140, 160 are affixed thereto.

In a further embodiment, the first fixed nut 140 has a winged configuration to assist with grasping the threaded bolt 130 and imparting moments upon it.

Although it is preferred for each adapter 10 to be secured to the ladder 13 by enveloping a ladder shoe 11, use of the adapter 10 is not limited to such securement. It is understood that an adapter 10 may replace the ladder shoe 11 altogether. With this method of use, the adapter 10 would be affixed to the ladder rails 12 as explained above.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized in a simple and straightforward manner with little or no training. After initial purchase or acquisition of the adapter 10, with any embodiment of attachment mechanism 30, it would be configured as indicated in FIG. 1.

The method of utilizing the adapter 10 may be achieved by performing the following steps: acquiring a model of the adapter 10; ensuring that the threaded bolts 130 are advanced away from the inner cavity 100 enough to accommodate insertion of a ladder shoe 11 into the inner cavity 100; slidably donning the adapter 10 over a ladder shoe 11 by inserting a ladder shoe 11 through the front 40 until its motion is arrested by the retention plates 150, 151; advancing the threaded bolts 130 towards the inner cavity 100 until the second ends 180 engage either the ladder shoe 11 or the opposing side 80, 90 of the adapter 10; setting the ladder 13 upright so that the teeth 120 make contact with the ground; and, benefiting from the non-slip engagement with the ground that each adapter 10 provides.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A traction adapter comprising:

a planar bottom side;

a planar top side positioned opposite of said bottom side and being a same height and width as said bottom side;

a planar first side;

a planar second side positioned opposite of said first side and being a same height and width as said first side;

said sides surrounding a front side opening, a rear side opening, and defining a substantially rectangular cross-section, wherein said front side opening defines a first plane;

a first plurality of teeth projecting away from an edge of the first side in a first direction while being coplanar with the first side, a second plurality of teeth projecting away from an edge of the second side in the first direction while being coplanar with the second side, wherein the first and second plurality of teeth are parallel to each other;

at least first and second threaded apertures disposed adjacent to each other within said first side, at least third and fourth threaded apertures disposed adjacent to each other within said second side, wherein said first threaded aperture substantially aligns with said third threaded aperture, and wherein said second threaded aperture substantially aligns with said fourth threaded aperture;

a planar first retention plate and a planar second retention plate each disposed in the first plane, the first retention plate extending in a substantially perpendicular direction from said top side in a direction toward the second retention plate, and the second retention plate extending in a substantially perpendicular direction from said bottom side in a direction toward the first retention plate such that a gap is formed between said retention plates;

at least first and second threaded bolts each respectively having a first end and a second end, each of the threaded bolts configured to threadingly engage at least one of the threaded apertures, wherein each of said threaded bolts has a wing nut disposed on a respective said first end of the threaded bolts, and each of said threaded bolts has a circular disc disposed on a respective said second end of the threaded bolts;

wherein said bottom side, said top side, said first side, and said second side form an inner cavity, wherein said inner cavity is configured to receive a linear object having foot, wherein said threaded bolts are configured to removably secure said linear object within said cavity as the foot of the object rests on the retention plates;

wherein a height of said bottom side, said top side, said first side and said second side is configured to prevent horizontal movement of said linear object, and said retention plates are configured to prevent movement of the foot through the first plane after the linear object has been inserted into said cavity via said rear side opening, wherein said retention plates are configured to support said foot as the linear object remains in an upright position during use; and, wherein each of said first and second plurality of teeth is configured to make contact with a surface for traction to prevent slippage when said adapter is securing said linear object in an upright position.

2. The traction adapter of claim 1 further comprising:

said linear object being a ladder; and said foot being a ladder shoe.

* * * * *